US006441739B2

(12) United States Patent
Rührig et al.

(10) Patent No.: US 6,441,739 B2
(45) Date of Patent: Aug. 27, 2002

(54) SECURITY ELEMENT FOR ELECTRONIC ARTICLE PROTECTION AND METHOD FOR PRODUCING THE SAME

(75) Inventors: Manfred Rührig, Weinheim (DE); Francois Cosnard, Sevres (FR)

(73) Assignee: Meto International GmbH, Hirschhorn (DE)

( * ) Notice: Subject to any disclaimer, the term of this patent is extended or adjusted under 35 U.S.C. 154(b) by 0 days.

(21) Appl. No.: 09/774,258

(22) Filed: Jan. 30, 2001

Related U.S. Application Data

(63) Continuation of application No. PCT/EP99/02131, filed on Mar. 29, 1999.

(30) Foreign Application Priority Data

Jul. 30, 1998 (DE) ..... 198 34 367

(51) Int. Cl.[7] ..... G08B 13/14

(52) U.S. Cl. ..... 340/572.6; 340/572.1; 340/572.3; 340/572.4; 340/572.8; 340/572.9

(58) Field of Search ..... 340/572.6, 572.1, 340/572.3, 572.4, 572.8, 572.9, 572.7, 551; 428/343, 346, 347, 354

(56) References Cited

U.S. PATENT DOCUMENTS

| | | | | |
|---|---|---|---|---|
| 2,613,007 A | | 10/1952 | von Hofe | |
| 2,667,003 A | | 1/1954 | von Hofe | |
| 4,960,651 A | | 10/1990 | Pettigrew et al. | |
| 5,156,910 A | * | 10/1992 | Raszewski | 428/343 |
| 5,560,970 A | * | 10/1996 | Ludebuhl | 428/41.9 |
| 5,602,528 A | | 2/1997 | Witchger | |
| 5,736,929 A | | 4/1998 | Schrott et al. | |
| 5,982,284 A | * | 11/1999 | Baldwin et al. | 340/572.8 |

FOREIGN PATENT DOCUMENTS

| | | |
|---|---|---|
| DE | 44 10 137 A1 | 9/1995 |
| EP | 0 459 722 A1 | 12/1991 |
| EP | 0 295 028 B1 | 4/1993 |
| EP | 0 412 137 B1 | 5/1994 |
| EP | 0 635 811 A1 | 1/1995 |
| GB | 1144597 | 3/1969 |
| GB | 2 312 595 A | 10/1997 |
| WO | WO 97/26564 | 7/1997 |

* cited by examiner

*Primary Examiner*—Jeffery Hofsass
*Assistant Examiner*—Daniel Previl
(74) *Attorney, Agent, or Firm*—Akin, Bump, Strauss, Hauer & Feld, L.L.P.

(57) ABSTRACT

A tape material (1) comprising a support layer (2) and a thin-layer magnetic material (3), which is placed onto the support layer (2), serves as a security material. In a surveillance zone the thin-layer magnetic material (3) emits a characteristic signal for the electronic surveillance of articles. The aim is to provide a tape material which allows for simple application of thin-layer materials on any support materials. To this end a transfer layer (4), which can be melted by pressure and/or heat, is provided for on the thin-layer material (3), and the adhesion between the support layer (2) and the thin-layer material (3) is less than the adhesion between the thin-layer material (3) and the transfer layer (4). Consequently, a hot-pressing die (7) may be utilized to transfer a desired area of the thin-layer material (3), via the transfer layer (4), onto the article (6*a*) or another support layer (6*b*).

8 Claims, 3 Drawing Sheets

SECURITY ELEMENT FOR ELECTRONIC ARTICLE PROTECTION AND METHOD FOR PRODUCING THE SAME

CROSS-REFERENCE TO RELATED APPLICATION

This application is a continuation of International Application No. PCT/EP99/02131, filed Mar. 29, 1999, the disclosure of which is incorporated herein by reference.

BACKGROUND OF THE INVENTION

This invention relates to a method for producing a security element for electronic article protection, the security element comprising a tape material with a foil as a carrier layer and with a thin-film material of magnetically soft, semi-hard or hard material applied to the carrier layer, which extend continuously over the entire tape material, and having a transfer layer in the form of an adhesive layer applied to the thin-film material. The invention is also directed to a security element, which is produced using the method.

A large number of different security elements are used in connection with electronic article protection, which is becoming increasingly popular for the prevention of inventory losses in department stores and warehouses. A particularly advantageous embodiment of a security element has become known in European Patent EP 0 295 028 B1. So-called thin-film security elements are described for the first time in this patent. Security elements made of thin-film materials distinguish themselves from otherwise commonly used strip-like and acousto-magnetic security elements by their small dimensions, which allow them to be used universally to protect different articles.

For the security elements to be deactivated following proper payment for the correspondingly protected article, a thin film of magnetically semi-hard or hard material is additionally provided on the magnetically soft thin film. A punched foil of nickel is proposed as a suitable deactivating material in European Patent EP 0 412 137 B.

Activatable security elements of thin-film material are comprised of a thin layer—preferable in the $\mu$ range—of magnetically soft, amorphous material. The layer is applied (sputtered) to a carrier substrate, for example by means of a physical deposition process under vacuum conditions. As an alternative, electrolytic deposition processes are also suitable for the production of thin-film materials. The thin-film starting material, usually present in the form of tape material, is subsequently punched into label shape and is applied as an adhesive label to an article to be protected. A disadvantage of the security elements of thin-film material that have become known, and/or of the known method of production, is that several intermediate steps are required before the security elements of the thin-film material are put in the desired label form and attached to the articles to be protected.

For example, International Application publication WO-A-79/026564, especially in FIG. 4B, shows a security element comprising a carrier layer and a magnetic thin-film material provided on the carrier layer. The magnetic thin-film material emits a characteristic signal in the query field of a surveillance zone of an electronic article-protection system. To be sure, this security element is likewise made of tape material. However, narrow, strip-like marking elements must be attached to it in a certain symmetrical arrangement before the tape material can be further processed to form the security element.

A security element is known from published British Patent Application GB-A-2 312 595, which has an additional carrier element of magnetically soft material and which has a magnetically semi-hard or hard magnetic thin-film material, that is transferred in individual segments onto the additional carrier element, such that the security element emits a coded characteristic signal in the query field of a surveillance zone. In this known security element the individual segments are applied by imprinting with a print head. Thus, several intermediate steps are also required before the security element can be put in a desired final form.

BRIEF SUMMARY OF THE INVENTION

An object of the invention is to provide a method for the production of a security element, which allows thin-film materials to be applied in a simple manner to carrier material. Furthermore, a security element produced using the method is to be provided.

This object is carried out in accordance with the invention by a method of producing a security element of the type described at the outset, wherein the transfer layer is caused to melt by local application of pressure and/or heat by a hot-stamping die, wherein the adhesion between the carrier layer and the thin-film material is less than the adhesion between the thin-film material and the transfer layer, so that by means of the hot-stamping die and the transfer layer an area of the thin-film material is separated from a larger continuous layer of the same, the thin-film material is parted from the carrier layer in this area and is applied to the article, wherein the thin-film material applied to the article emits a characteristic signal in the query field of a surveillance zone of an electronic article-protection system. The object is also achieved by a security article made by the above method, wherein the thin-film material applied to the article is structured in itself and has the form of a hologram.

To purposefully influence the adhesive force between the carrier layer and the thin-film material, according to an advantageous embodiment of the invention, a wax-like release layer is provided, which melts when it is heated by the hot-stamping die.

According to an advantageous further embodiment of the invention, the thin-film material is a magnetically soft thin film or a magnetically semi-hard or hard thin film, wherein a magnetically semi-hard or hard layer is always employed in combination with the magnetically soft thin-film material for the deactivation of the magnetically soft thin-film material.

According to a preferred embodiment of the invention, the carrier layer is a polyester foil. Furthermore, according to an advantageous further embodiment of the invention, the transfer layer is an adhesive layer with a melting point preferably within the range of 60° C.–150° C. The adhesive layer melts under the thermal action of the hot-stamping die and upon cooling produces an intimate connection between the article or the carrier layer and the thin-film material.

A major advantage of the invention is that the security element can be applied with no problems at all to any desired place on any type of substrate whatsoever by means of one single method step, namely that of hot stamping. Let us consider the merits of the invention on the basis of a concrete example: The security element is to be applied to an information label such as a label on a bottle. Such bottle labels are printed as tape material, and are then cut into individual labels and stacked. The thin-film security elements can be applied to the backs of the labels by a hot-stamping die in a printing machine while the label fronts are being printed. It is also quite possible in special cases to apply the thin-film security elements to the front of the labels for decorative purposes.

Bottle labels are stacked before they are applied to the respective articles. Since, contrary to the strip-like or acousto-magnetic security elements, the thin-film security elements are very thin, stacking the labels is relatively non-problematic. This is true even if the security elements are always applied to the labels at the same place. Of course, in accordance with the invention, it is also possible to arrange the security elements in different areas to ensure fully uniform stacking heights over the entire area of the labels. This is a possibility for which the security elements according to the invention and their method of application according to the invention are very well suited.

A further advantage of the invention is doubtless also that as a result of their slight thickness, the security elements under the labels applied to the articles are not at all visible or only barely visible from the outside.

An advantageous further embodiment of the security element according to the invention provides for the thin-film material to be structured in itself and to have the form of a hologram. A universally usable and inexpensive marking element is made available by the direct combination of security element and proof of authenticity.

According to the invention, a magnetically soft security element can be embodied so as to be deactivatable in that a magnetically semi-hard or hard thin-film material is applied to the magnetically soft thin-film material. Thus, in this case the additional carrier layer is the activatable security element made of a magnetically soft thin-film material.

Whereas on the basis of the security elements described above the only information provided is whether or not a protected article is located within the surveillance zone, in an advantageous embodiment the security element according to the invention provides coded information that permits a specific article to be detected with certainty. For this purpose, the magnetically soft thin-film material is transferred in individual segments onto the article or the additional carrier layer in such a manner that the security element emits a coded characteristic signal in the query field of a surveillance zone.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

DETAILED DESCRIPTION OF THE INVENTION

Figure 1:
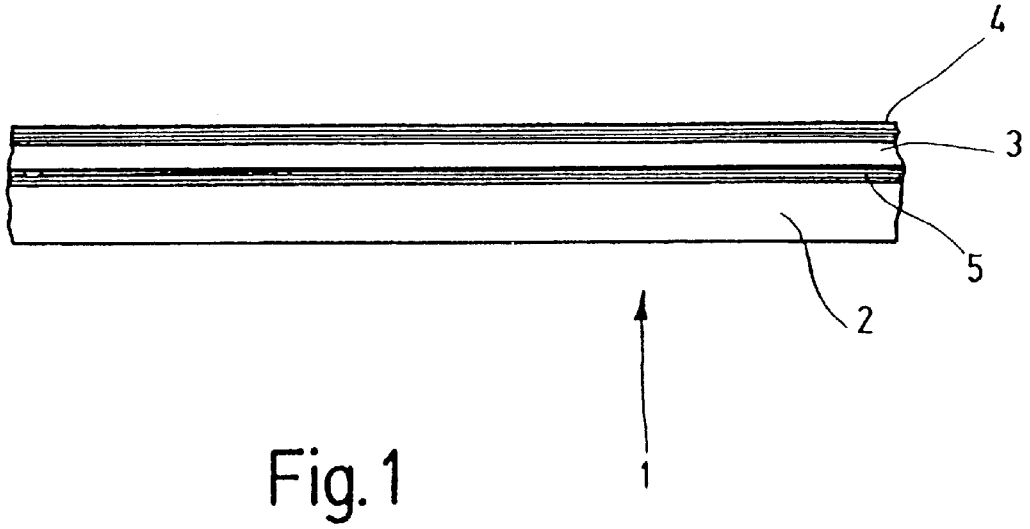
FIG. 1 is a cross section through a tape material used as a starting material.

FIG. 1 shows a cross section through a tape material 1. The tape material 1 comprises a carrier layer 2 preferably made of polyester foil, a release layer 5 which, for example, can be a wax layer, a magnetically soft or magnetically semi-hard or hard thin-film material 3, and a pressure or heat-sensitive transfer layer 4. As already explained above, the additional release layer 5 can be omitted if the carrier layer 2 per se already possesses the required low adhesion with reference to the thin-film material 3.

Figure 2:
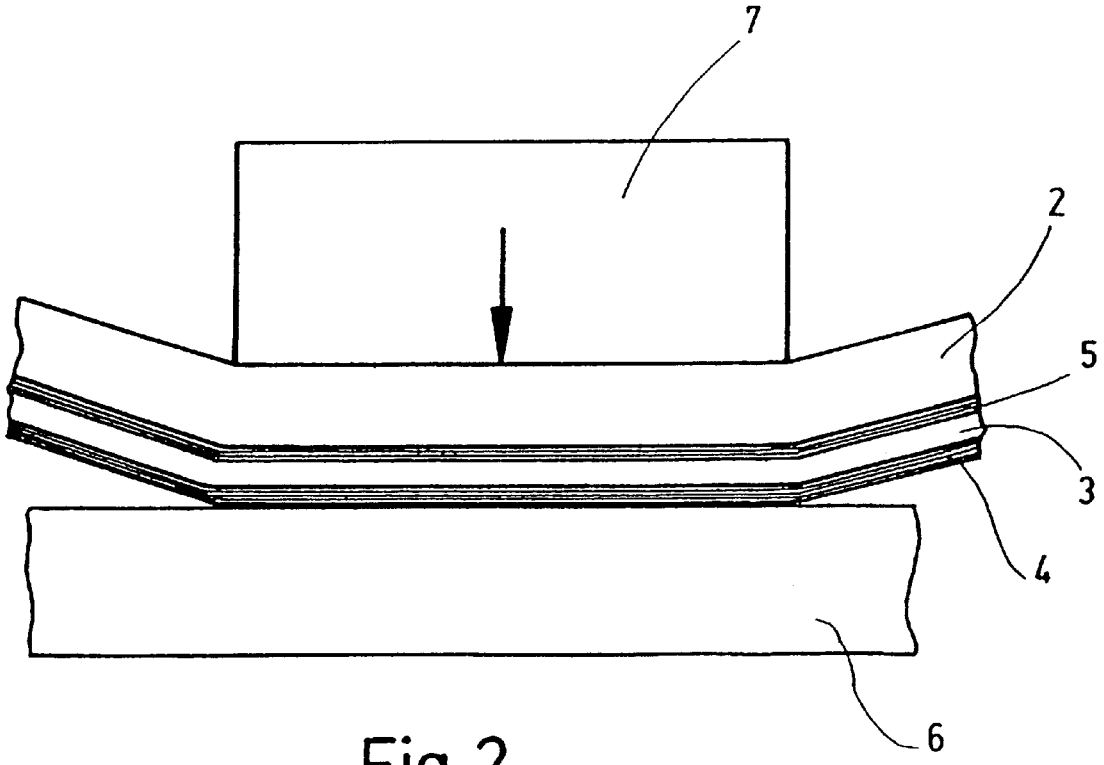
FIG. 2 is a cross section through the tape material at the moment of hot stamping.

As shown schematically in FIG. 2, the thin-film material 3 provided with the transfer layer 4 can be transferred under the action of a hot-stamping die 7 onto any other carrier layer 6. This carrier layer 6 can be a bottle label, for example. The security element, for instance, is applied to the back of the bottle label; the bottle label is subsequently glued onto a bottle. As a result of the slight thickness of the thin-film material, a potential shoplifter will not be able to recognize from the outside whether or not the article, in this case the bottle, is protected against theft by an electronically detectable security element.

The outer form of the security element 8 can of course be designed in any manner by using an appropriately formed hot-stamping die 7 to transfer the security element 8 onto the article 6*a* or onto an additional carrier layer 6*b*. To additionally impress the form of a hologram on the security element 8 the hot-stamping die 7 must have a corresponding surface structure.

Figure 3:
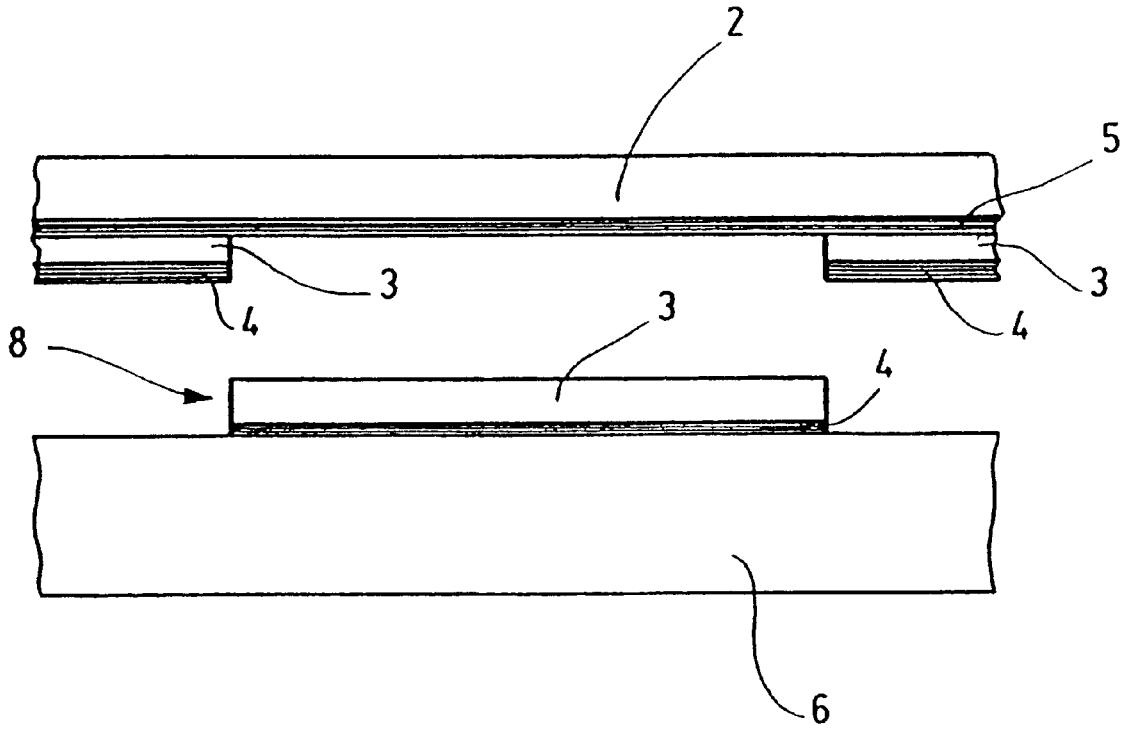
FIG. 3 is a cross section through the tape material following completion of the hot stamping.

FIG. 3 shows a cross section through the tape material 1 and through the security element 8 following completion of the hot-stamping process.

Figure 4:
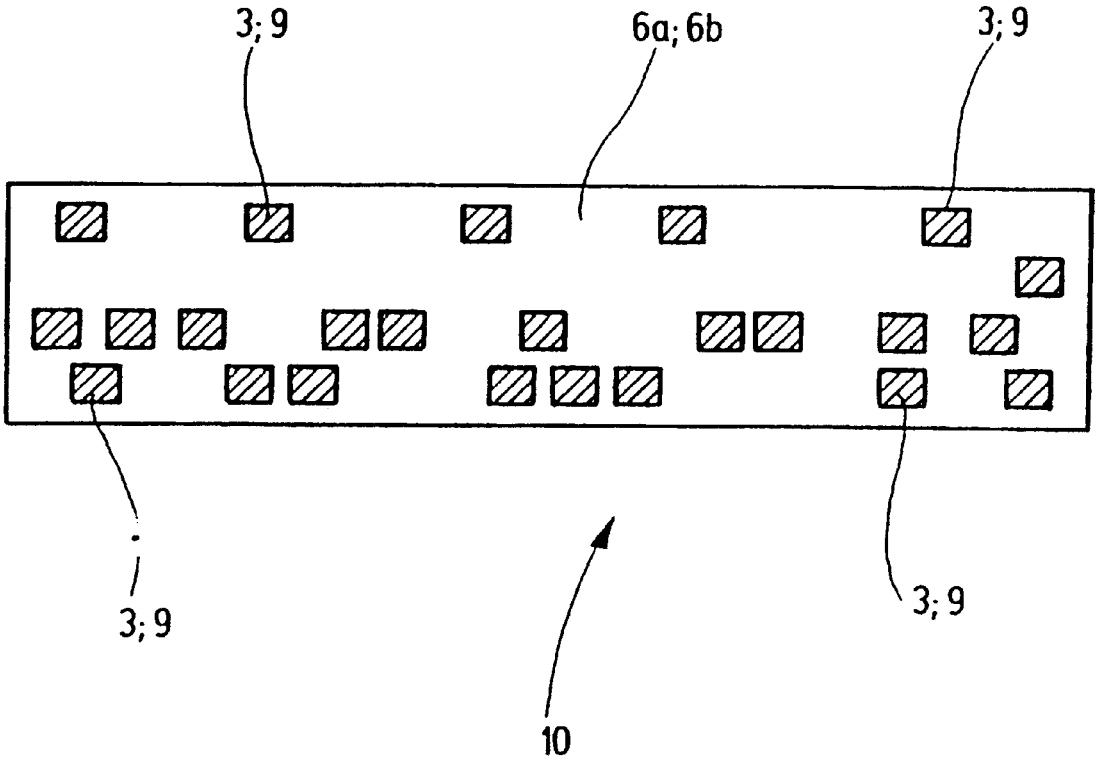
FIG. 4 is a plan view of an advantageous embodiment of an identification element according to the invention.

In FIG. 4 a plan view of an advantageous embodiment of an identification element 10 is shown. The magnetically soft thin-film material 3 is arranged in individual segments 9 on the carrier layer 6*a*, 6*b* in such a manner that it emits a coded characteristic signal in the query field of an electronic article-protection system, which signal can be clearly associated with the corresponding article 6*a*. Aside from the purely protective function, an element designed in this way also has an identifying function.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A method for applying a security element, which emits a characteristic signal in a query field of a surveillance zone of an electronic article-protection system, to a bottle label, the method comprising:

a) providing a bottle label and a tape material, wherein the tape material comprises a carrier layer, a magnetic thin-film material applied to the carrier layer, and a transfer layer applied to the thin-film material, wherein the transfer layer melts under application of pressure and/or heat, and wherein adhesion between the carrier layer and the thin-film material is less than adhesion between the thin-film material and the transfer layer, and b) using the transfer layer to transfer a desired area of the thin-film material to the bottle label under local application of pressure and/or heat from a hot-stamping die.

2. The method according to claim 1, wherein the carrier layer comprises a polyester foil.

3. The method according to claim 1, wherein the transfer layer comprises an adhesive layer with a melting point lying in a range of 60° C.–150° C.

4. The method according to claim 1, wherein the thin-film material comprises a magnetically soft thin-film material.

5. The method according to claim 4, wherein a magnetically semi-hard or hard thin-film material is applied to the magnetically soft thin-film material.

6. The method according to claim 5, further comprising transferring a plurality of areas of the thin-film material to the bottle label in such a manner that the security element emits a coded identification signal in a query field of a surveillance zone of an electronic article-protection system.

7. The method according to claim 4, further comprising transferring a plurality of areas of the thin-film material to the bottle label in such a manner that the security element emits a coded identification signal in a query field of a surveillance zone of an electronic article-protection system.

8. The method according to claim 1, further comprising transferring the thin-film material to a back side of the bottle label.

* * * * *